United States Patent [19]

Dennis

[11] Patent Number: 4,958,754

[45] Date of Patent: Sep. 25, 1990

[54] DISPENSER OR SPRAYER WITH VENT SYSTEM

[75] Inventor: Stephen R. Dennis, St. Charles, Mo.

[73] Assignee: Continental Sprayers, Inc., St. Peters, Mo.

[21] Appl. No.: 317,568

[22] Filed: Mar. 1, 1989

[51] Int. Cl.[5] ..... B67D 5/40

[52] U.S. Cl. ..... 222/383; 222/372; 222/382; 239/333

[58] Field of Search ..... 239/333; 222/372, 382, 222/383, 481–484

[56] References Cited

U.S. PATENT DOCUMENTS

| | | | |
|---|---|---|---|
| D. 240,036 | 5/1976 | Tada . | |
| D. 241,543 | 9/1976 | Tada . | |
| D. 242,351 | 9/1976 | Tada . | |
| D. 243,333 | 2/1977 | Tada . | |
| D. 256,271 | 8/1980 | Tada . | |
| 3,701,478 | 10/1972 | Tada . | |
| 3,797,749 | 3/1974 | Tada . | |
| 3,897,006 | 7/1975 | Tada . | |
| 3,913,841 | 10/1975 | Tada . | |
| 4,072,252 | 2/1978 | Steyns et al. . | |
| 4,153,203 | 5/1979 | Tada . | |
| 4,191,313 | 3/1980 | Blake et al. | 222/383 |
| 4,230,277 | 10/1980 | Tada . | |
| 4,336,895 | 6/1982 | Aleff | 222/383 |
| 4,350,298 | 9/1982 | Tada . | |
| 4,558,821 | 12/1985 | Tada et al. . | |
| 4,640,444 | 2/1987 | Bundschuh | 222/383 |
| 4,669,664 | 6/1987 | Garneau | 222/383 |
| 4,678,122 | 7/1987 | Riglietti | 222/383 |
| 4,728,009 | 3/1988 | Schmidt | 222/383 |
| 4,815,663 | 3/1989 | Tada | 222/383 |
| 4,826,052 | 5/1989 | Micallef | 222/372 |

FOREIGN PATENT DOCUMENTS

| | | | |
|---|---|---|---|
| 230968 | 8/1987 | European Pat. Off. | 239/333 |
| 254505 | 1/1988 | European Pat. Off. | 222/383 |
| 52-11686 | 3/1977 | Japan . | |

*Primary Examiner*—Joseph J. Rolla
*Assistant Examiner*—Steve Reiss
*Attorney, Agent, or Firm*—Sandler, Greenblum & Bernstein

[57] ABSTRACT

A dispenser adapted to be connected to a container includes a first bore having an outlet for dispensing fluent material, a second bore containing a piston connected to a trigger for pumping the fluent material, and a third bore containing a vent opening and a piston for sealing the vent opening when the trigger is in the non-pumping position. A valve, spinner and springs in the first bore are unitarily formed from a plastic material.

46 Claims, 2 Drawing Sheets

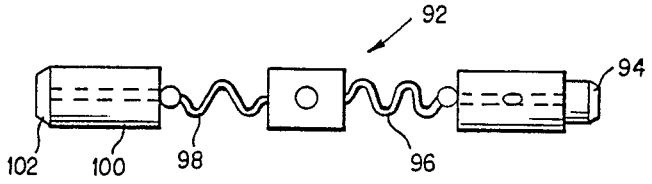
FIG. 2
FIG. 3
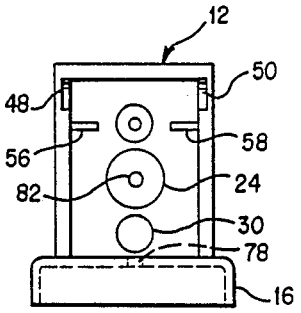
FIG. 4
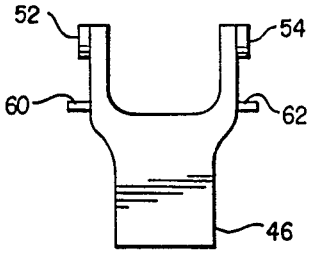
FIG. 5
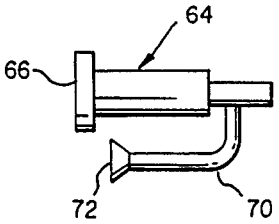
FIG. 6
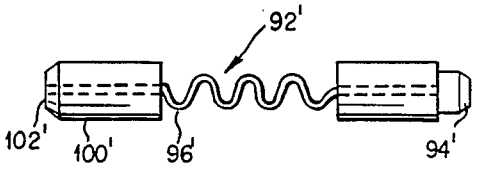

DISPENSER OR SPRAYER WITH VENT SYSTEM

BACKGROUND OF THE INVENTION

1. Field of the Invention

The present invention is directed to dispensers or sprayers, and more particularly to dispensers and sprayers provided with a venting system. More specifically, the present invention is directed to a dispenser or sprayer having three bores which is provided with a vent system in one of the bores.

2. Discussion of Background and Material Information

A common problem with liquid spraying devices of the hand-operated type is the need for relief of the negative pressure or vacuum created in the closed container on which the device is used as liquid is pumped. The vacuum created is relieved by venting atmospheric air into the container to displace the liquid dispensed.

One manner of accomplishing this venting of atmospheric air into a container is merely to place a hole in the container to allow air from the outside to enter. A major disadvantage with this simple solution is that the contents of the container can easily spill out through this hole when the sprayer is tilted at an angle or carelessly handled. Moreover, even a small hole in the container, would permit the contents of the container to evaporate.

Various solutions to this simple manner of venting have been proposed in the art, and, in general, usually involve separate or discrete valve means with or without a vent passage, and more often than not, are difficult to construct and are expensive. In addition, prior art devices are often cumbersome to use and operate.

In designing a vent mechanism for permitting outside air to enter a container during spraying, it is important that the container/sprayer combination not leak when the trigger or actuator is at rest, and when the container and sprayer are laid on a side or inverted such as might be the case in normal use in spraying or in shipment where a full container might be supplied with an attached spraying device.

A number of patents have been issued on trigger-piston type hand sprayers useful for dispersing liquids from containers. For example, U.S. Pat. No. 4,072,252 to Emile B. STEYNS et al. discloses a hand operated sprayer with an automatic container vent mechanism. To accomplish the automatic venting in the hand sprayer taught in this patent, the seals on a piston are caused to pass beyond a vent opening leading to the interior of the container when the trigger is pulled. Further reference is made to U.S. Pat. No. 4,072,252 for its description of various solutions to the venting problem.

Japanese Utility Patent No. 52-11686, which issued on Mar. 15, 1977, discloses a hand operated sprayer in which the spray outlet and valves are incorporated into a main piston that moves in a first bore. The ventilation piston is connected to the main piston and moves in a second bore. The ventilation piston slides to the rear of increasingly smaller diameters of the second bore.

U.S. Pat. Nos. 3,897,006, 4,153,203, 4,230,277 and 4,350,298 to TADA disclose hand operated sprayers in which a rod depresses a portion of elastic packing to separate the portion from the housing to allow air to pass into the container. A torsion spring biases the trigger to the non-pumping position in U.S. Pat. Nos. 4,153,203, 4,230,277, and 4,350,298.

U.S. Pat. Nos. 3,797,749, 3,913,841, and 3,701,478 to TADA, 4,558,821 to TADA et al. and Design Patent Nos. 240,036, 241,543, 242,351, 243,333, and 256,271 to TADA are all directed to other types of hand operated sprayers.

The vent system as described below can be adapted to be used with any of the above types of sprayers.

SUMMARY OF THE INVENTION

It is an object of the present invention to establish a ventilation chamber which connects the inside of the container to the outside air only at the time of spraying in order to relieve the problem of negative pressure.

It is another object of the present invention to provide a vent system for a sprayer which is simple in construction, efficient in operation, and is easily and economically manufactured.

Other objects and advantages of the present invention will be apparent from the detailed description and drawings which follow.

A dispenser that accomplishes these objects in accordance with the present invention includes a housing adapted to be attached to a container, a first bore having an outlet for dispensing or spraying fluent material, a second bore having a piston connected to an operating trigger, a third bore having a vent for permitting ambient air to enter the container, and a second piston for sealing the vent when the trigger is in a non-pumping position and allowing ambient air to pass through the vent to the container when the trigger is in the pumping position.

More specifically, the present invention is directed to a dispenser adapted to be attached to a container for holding a fluent material to be dispensed to the ambient which includes a housing adapted to be attached to the container; a first outwardly opening bore, having an outer and inner end, located within the housing and having an outlet for dispensing the fluent material; a second outwardly opening bore, having an outer and inner end, located within the housing and having a first piston shiftable within the second bore; operating means for shifting the first piston within the second bore between a non-pumping and pumping position; a third outwardly opening bore, having an outer and inner end, located within the housing and having venting means for permitting communication between the container and the ambient; a second piston shiftable within the third bore for sealing the venting means when in a non-pumping position and allowing communication between the container and the ambient when in a pumping position, wherein the second piston is operably connected to the operating means.

In accordance with the present invention, the venting means preferably includes an opening extending through the housing and opening at one end into the third bore. A fourth bore within the housing is in communication with the first and second bores, preferably extending substantially transversely to the first, second, and third bores, and wherein each of the first bore and second bore include at least one opening at each inner end for the communication with the fourth bore.

A first valve is located in the fourth bore between each opening to the first bore and the second bore. Preferably the first valve comprises a ball check valve. Further, a tube is inserted in the fourth bore to extend beyond the fourth bore of the housing. The dispenser further includes a second valve in the first bore for sealing the opening in the first bore when the operating means is in the non-pumping position. The second valve preferably includes means for biasing the second valve toward the sealing position and preferably the biasing means is a spring. In a preferred embodiment, the spring and second valve means are unitarily formed in one piece. Furthermore, the dispenser includes a spinner within the first bore, and preferably the spinner is also unitarily formed with the spring and second valve means.

In the dispenser, in accordance with the present invention, the second piston is adapted to have a sealing relation with at least an outer portion of the third bore when the operating means is in the non-pumping position and preferably the third bore is so dimensioned that the second piston is in non-sealing relation when the second piston is in non-sealing relation when the operating means is in the pumping position, so that fluid from the ambient may pass the piston to the venting means.

The operating means of the dispenser includes resilient means to urge the first piston to the non-pumping position which preferably is a spring located within the second bore. The spring could also be a torsion spring located outside of the second bore.

In another aspect of the invention, the dispenser includes a cover located at the outer end of the first bore.

Preferably the operating means includes a trigger that is pivotally attached to the housing adjacent the outer end of the first bore.

Another aspect of the present invention is directed to the combination of a dispenser, as otherwise described above, attached to a container for holding a fluent material to be dispensed.

Another further aspect of the present invention is a method of using the combination of the dispenser and container which involves moving the operating means to a pumping position to dispense fluent material and simultaneously unseal venting means to allow fluid from the ambient to enter the container.

A still further aspect of the present invention is a valve which includes a sealing portion, a spring for urging the sealing portion to a sealing position, and a spinner, wherein the sealing portion, the spring, and the spinner are unitarily formed in one piece and is made from a plastic material. Alternatively, the valve may be constructed of three elements and the spring may be made of metal.

BRIEF DESCRIPTION OF THE DRAWINGS

FIG. 2 is an elevation view of a preferred embodiment of a valve.

FIG. 3 is an end view of a preferred embodiment of the housing with all other elements removed.

FIG. 4 is an end view of a preferred embodiment of the trigger.

FIG. 5 is an elevation view of a preferred embodiment of the piston unit.

FIG. 6 is an elevation view of an alternate embodiment of the valve.

DETAILED DESCRIPTION AND OPERATION OF THE INVENTION

Figure 1:
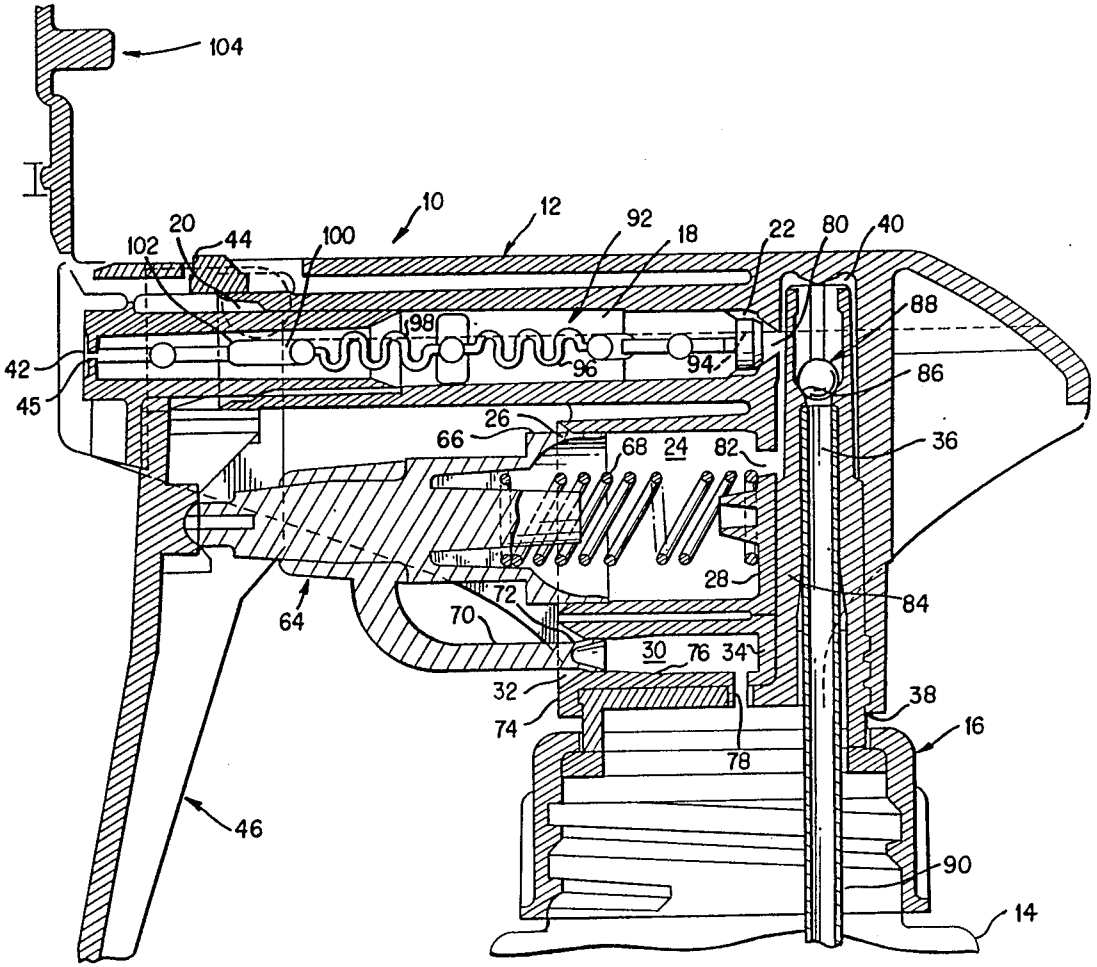
FIG. 1 is a sectional elevation view of a preferred embodiment of the invention showing a dispenser mechanism in its at rest or non-pumping position.

Referring to FIG. 1, a manually operated dispenser or sprayer 10 is provided with a housing 12 that is adapted to be attached to container 14 by cap 16. A first outwardly opening bore 18 having an outer end 20 and an inner end 22 is formed within the housing 12. A second outwardly opening bore 24 having an outer end 26 and an inner end 28 is formed within the housing 12 below the first bore 18. A third outwardly opening bore 30 having an outer end 32 and an inner end 34 is also formed within the housing 12 below the second bore. A fourth bore 36 having a lower end 38 and an upper end 40 is formed within the housing 12 and extends transversely to the first, second, and third bores. A nozzle portion 42 is telescopically inserted into the outer end of the first bore 18 and is held in place by detent 44. The nozzle portion includes an exit orifice or spray nozzle 45.

A trigger 46 is pivotally attached to the housing at pivot points 48 and 50 by pivots 52 and 54, respectively (FIG. 3). The housing includes limit stops 56 and 58 that are engaged by projections 60 and 62, respectively, on the trigger to stop the trigger in the non-pumping position (FIGS. 3 and 4). A piston unit 64 is adapted to be moved by the trigger 46. The piston unit includes a first piston 66 that slides in sealing relation in second bore 24. A spring 68 biases the piston and therefore the trigger 46 to the non-pumping position. A second piston 70 is attached to the first piston 66 and slides in third bore 30. The second piston includes an end portion 72 that is adapted to be in sealing relation with a portion 74 adjacent to the outer end 32 of the third bore. The inner diameter of portion 76 of the third bore is larger than the inner diameter of portion 74, so that the end portion 72 is not in sealing relation to the third bore when it is at position 76. The third bore 30 includes a vent opening 78 that extends through the housing to permit ambient air to enter the container when the end portion 72 of the second piston 70 is at portion 76. That is, when the trigger is moved to the pumping position, the end portion 72 is moved to portion 76 and ambient air may then flow from the outer end of third bore 30, around the end portion 72, and through the vent opening 78 into the container.

First bore 18 includes an opening 80 at the inner end 22 for fluid communication with fourth bore 36. Second bore 24 also includes an opening 82 at the inner end 28 for communication with the fourth bore. Valve case 84 is inserted into the fourth bore 36 and includes a valve seat 86 near the upper end 40 and located between openings 80 and 82. A ball valve 88 is adapted to seat in the valve seat 86. A suction tube 90 is inserted into fourth bore at the lower end 38.

Valve member 92 in first bore 18 is adapted to seal the opening 80. As shown in FIG. 2, the valve member includes a sealing portion 94, spring portions 96 and 98, an abutment portion 100, and spinner 102. The abutment portion 100 is held against a portion of nozzle portion 42 so that the springs 96 and 98 urge the sealing portion against the inner end 22 to seal opening 80. Spinner 102 swirls fluent material to facilitate spraying. The valve member, which includes the sealing portion 94, spring portions 96 and 98, abutment portion 100, and spinner 102 is unitarily formed in one piece out of a plastic material.

An alternative valve member 92' is shown in FIG. 6. This valve member includes a sealing portion 94', abutment portion 100' and spinner 102'. Metal spring 96' connects the sealing portion 94' and abutment portion 100'. Valve 92' operates in the same manner as valve 92.

A cover member 104 is hinged to nozzle portion 42 to selectively close the spray nozzle 45.

In operation, container 14 is filled with a fluent material, e.g., a material selected from the group consisting of liquid, gas, and a flowable solid, such as powder and the dispenser 10 is attached to the container by cap 16 with suction tube 90 extending below the material surface. When dispensing or spraying is desired, trigger 46 is squeezed, forcing first piston 66 into bore 24, and thereby forcing the air in bore 24 through opening 82 to force ball valve 88 against valve seat 86. Air above the ball valve 88 forces sealing portion 94 away from opening 80 against the biasing force of springs 98 and upon subsequent squeezing of the trigger allows the fluent material to pass the spinner 102 and be discharged from spray nozzle 45. When trigger 46 is released, piston 66 moves leftwardly under the force of compressed spring 68 and the trigger returns to the non-pumping position. This action causes an increase in the volume of chamber 11 and a slight vacuum develops which opens ball valve 88 and allows sealing portion 94 to again close opening 80. Simultaneously, fluent material is drawn up into the upper end 40 of bore 36 through tube 90. Subsequent squeezing and releasing of trigger 46 repeats the above cycle and allows the fluent material to be dispensed or sprayed through nozzle 45.

Ambient air is allowed to enter the container 14 through vent opening 78 at the same time the trigger 46 is squeezed since the end portion 72 of second portion 70 would then be located at portion 76. Since the inner diameter of portion 76 is larger than the outer diameter of end portion 72 and the outer diameter of the remainder of piston 70 is smaller than the outer diameter of end portion 72, ambient air is allowed to flow from the outer end of third bore 30, around the end portion 72, and through the vent opening 78 into the container.

Various modifications to the above described dispenser may be made without departing form the spirit and scope of the claims. For example, the trigger may be reciprocally mounted on the housing and the spring 68 may be located outside the bore 24 and may be a type of spring other than a coil spring such as a torsion spring, or the like.

Also, the cover member may be a rotating nozzle closure such as taught by U.S. Pat. No. 3,913,841 or one that is pushed to close and pulled to open such as that taught in U.S. Pat. No. 4,350,298. The pushing and pulling may be either laterally or longitudinally of the housing. Also, different types of nozzles may be used, e.g., nozzles that emit a foam or a spray. These nozzles may act in combination with a closure to selectively emit the foam or spray.

Although the invention has been described with respect to particular means and embodiments, it is to be understood that the invention is not limited to the particulars disclosed and extends to all equivalents falling within the scope of the claims.

What is claimed is:

1. A dispenser adapted to be attached to a container for holding a fluent material to be dispensed to the ambient comprising:

(a) a housing adapted to be attached to the container;

(b) a first outwardly opening bore, having an outer and inner end, located within said housing and having an outlet for dispensing the fluent material;

(c) a second outwardly opening bore, having an outer and inner end, located within said housing and having a first piston shiftable within the second bore;

(d) operating means for shifting the first piston within the second bore between a non-pumping and pumping position;

(e) a third outwardly opening bore, having an outer and inner end, located within said housing and having venting means for permitting communication between the container and the ambient, wherein said first, second, and third bores each have a center axis, and said center axes of said bores are both offset and parallel relative to each other;

(f) a second piston shiftable within said third bore for sealing the venting means when in a non-pumping position and allowing communication between the container and the ambient when said second piston moves from said non-pumping position toward said pumping position, said second piston being operably connected to said operating means.

2. The dispenser according to claim 1, and further comprising a fourth bore within said housing being in communication with the first and second bores.

3. The dispenser according to claim 2, wherein said fourth bore extends substantially transversely to the first, second, and third bores.

4. The dispenser according to claim 3, wherein each said first bore and second bores include at least one opening at each said inner end for the communication with said fourth bore.

5. The dispenser according to claim 4, and further including a first valve in said fourth bore between each said opening to said first bore and said second bore.

6. The dispenser according to claim 5, wherein said first valve comprises a ball check valve.

7. The dispenser according to claim 5, and further including a second valve in said first bore for sealing the opening in the first bore when the operating means is in the non-pumping position.

8. The dispenser according to claim 7, wherein the second valve includes means for biasing the second valve toward the sealing position.

9. The dispenser according to claim 8, wherein the biasing means comprises a spring. .

10. The dispenser according to claim 9, wherein the spring and second valve means are unitarily formed in one piece.

11. The dispenser according to claim 10, and further including a spinner within said first bore.

12. The dispenser according to claim 11, wherein the spinner is unitarily formed with said spring and second valve.

13. The dispenser according to claim 2, and further including a tube inserted in said fourth bore to extend beyond said fourth bore of said housing.

14. The dispenser according to claim 1, wherein the venting means comprises an opening extending through the housing and opening at one end into the third bore.

15. The dispenser according to claim 14, wherein said second piston is adapted to have a sealing relation with at least an outer portion of said third bore when said operating means is in the non-pumping position.

16. The dispenser according to claim 15, wherein the third bore is so dimensioned that said second piston is in non-sealing relation with said third bore when said operating means is in the pumping position, so that fluent from the ambient may pass the piston to said venting means.

17. The dispenser according to claim 1, wherein said operating means incudes resilient means for urging said first piston to the non-pumping position.

18. The dispenser according to claim 17, wherein said resilient means comprises a spring located within said second bore.

19. The dispenser according to claim 1, and further comprising a cover located at the outer end of said first bore.

20. The dispenser according to claim 1, wherein said operating means comprises a trigger.

21. The dispenser according to claim 20, wherein said trigger is pivotally attached to said housing adjacent the outer end of said first bore.

22. The dispenser according to claim 1, wherein said second bore is spaced from said first bore an d said third bore.

23. A combination of a dispenser attached to a container for holding a fluent material to be dispensed comprising:

(a) a container;

(b) a housing attached to said container;

(c) a first outwardly opening bore having an outer and inner end, located within said housing and having an outlet for dispensing the fluent material;

(d) a second outwardly opening bore, having an outer and inner end, located within said housing and having a first piston shiftable within the second bore;

(e) operating means for shifting the first piston within the second bore between a non-pumping and pumping position;

(f) a third outwardly opening bore, having an outer and inner end, located within said housing and having venting means for permitting communication between the container and the ambient, wherein said first, second, and third bores each have a center axis, and said center axes of said bores are both offset and parallel relative to each other;

(g) a second piston shiftable within said third bore for sealing the venting means when in a non-pumping position and allowing communication between the container and the ambient when said second piston moves from said non-pumping position toward said pumping position, said second piston being operably connected to said operating means.

24. The combination according to claim 23, and further comprising a fourth bore within said housing being in communication with the first and second bores.

25. The combination according to claim 24, wherein said fourth bore extends substantially transversely to the first, second, and third bores.

26. The combination according to claim 25, wherein, each said first bore and second bores, include at least one opening at their inner ends for the communication with said fourth bore.

27. The combination according to claim 26, and further including a first valve in said fourth bore between the openings to said first and second bores.

28. The combination according to claim 27, wherein said first valve comprises a ball check valve.

29. The combination according to claim 26, and further including a second valve in said first bore for sealing the opening in the first bore when the operating means is in the non-pumping position.

30. The combination according to claim 29, wherein the second valve includes means for biasing the second valve toward the sealing position.

31. The combination according to claim 30, wherein the biasing means comprises a spring.

32. The combination according to claim 31, wherein the spring and second valve are unitarily formed in one piece.

33. The combination according to claim 32, and further including a spinner within said first bore.

34. The combination according to claim 33, wherein the spinner is unitarily formed with said spring and second valve.

35. The combination according to claim 24, and further including a tube inserted in said fourth bore to extend beyond said fourth bore of said housing into said container.

36. The combination according to claim 23, wherein the venting means comprises at least one opening extending through the housing and opening at one end into said third bore.

37. The combination according to claim 36, wherein said second piston is adapted to have a sealing relation with at least an outer portion of said third bore when said operating means is in the non-pumping position.

38. The combination according to claim 37, wherein the third bore is so dimensioned that said second piston is in a non-sealing relation with said third bore when said operating means is in the pumping position, so that fluid from the ambient may pass the piston to said venting means.

39. The combination according to claim 23, wherein said operating means includes resilient means for urging said first piston to the non-pumping position.

40. The combination according to claim 39, wherein said resilient means comprises a spring located within said second bore.

41. The combination according to claim 23, wherein said operating means comprises a trigger.

42. The combination according to claim 41, wherein said trigger is pivotally attached to said housing adjacent the outer end of said first bore.

43. The combination according to claim 23, wherein the container is at least partially filled with a fluent material.

44. The combination according to claim 43, wherein said fluent material is a liquid.

45. The combination according to claim 23, and further comprising a cover located at the outer end of said first bore.

46. The combination according to claim 23, wherein said second bore is spaced from said first bore and said third bore.

* * * * *